United States Patent [19]

Mueller et al.

[11] Patent Number: 4,566,472

[45] Date of Patent: Jan. 28, 1986

[54] APPARATUS FOR APPLYING A COLOR MEDIUM TO HAIR

[76] Inventors: Siegfried Mueller, Bauschengasse 14; Eberhard Schäfer, Hammerbuehl 23, both of 7737 Bad Duerrheim, Fed. Rep. of Germany

[21] Appl. No.: 499,929

[22] Filed: Jun. 1, 1983

[30] Foreign Application Priority Data

Jun. 5, 1982 [DE] Fed. Rep. of Germany ..... 3221410

[51] Int. Cl.[4] ..... A45D 24/22

[52] U.S. Cl. ..... 132/112; 132/110; 132/116; 132/161; 401/268

[58] Field of Search ..... 132/109, 110, 111, 112, 132/113, 114, 115, 116, 162, 79 B, 88.7, 160, 161; 401/268

[56] References Cited

U.S. PATENT DOCUMENTS

| | | | |
|---|---|---|---|
| 1,707,665 | 4/1929 | Julien | 132/112 X |
| 2,513,865 | 7/1950 | Hazza et al. | 132/113 |
| 2,609,822 | 9/1952 | McCormack et al. | 132/161 X |
| 4,462,413 | 7/1984 | Schmitz | 132/113 |

FOREIGN PATENT DOCUMENTS

| | | | |
|---|---|---|---|
| 828902 | 1/1952 | Fed. Rep. of Germany | 132/111 |
| 2307490 | 11/1976 | France | 132/112 |
| 111147 | 7/1944 | Sweden | 132/112 |

*Primary Examiner*—Steven A. Bratlie

*Attorney, Agent, or Firm*—Flynn, Thiel, Boutell & Tanis

[57] ABSTRACT

An apparatus for applying color to hair includes a color-applying comb having several teeth which are substantially triangularly shaped in a top view, are arranged on a comb back, are spaced by relatively large distances, and are tapered toward their tips. The gaps which lie between the teeth are substantially triangularly shaped in a top view and taper toward the comb back. Each tooth has in its enlarged part and in the vicinity of the comb back a color chamber, and has a narrow slot which extends perpendicular to the comb back from the tooth tip into the color chamber.

17 Claims, 8 Drawing Figures

APPARATUS FOR APPLYING A COLOR MEDIUM TO HAIR

FIELD OF THE INVENTION

The invention relates to an apparatus for applying a color medium to hair and, more particularly, to such an apparatus which includes a color-applying comb having several teeth arranged on a comb back and having gaps therebetween.

BACKGROUND OF THE INVENTION

Such a color-applying apparatus is used for coloring separate, fine strands of hair. A known color-applying comb is constructed like a normal comb with rough teeth. To color the strands of hair, the inner ends of the gaps between the teeth are filled with a color medium and the comb is then pulled through the hair. The color mass is hereby applied to the strands of hair which slide between the teeth. Since, however, the tooth gaps lie relatively close to each other and since they also receive a relatively large number of strands of hair, a relatively extensive application of the color medium results, so that too much hair is colored and not in the form of separate strands. Furthermore, the narrow gaps between the teeth can only hold a relatively small amount of the color medium, so that when the hair is relatively long, the quantity of color medium is not sufficient to color strands of hair over their entire length. Also, the gaps must be refilled with the color medium each time the comb is pulled through the hair. Since, with the teeth of the known color-applying comb, coloring of separate strands of hair cannot be satisfactorily achieved, the conventional comb has at the free end of its handle a slot which is constructed like one of the gaps between the teeth of the comb. Therefore, only a relatively small amount of the color medium can be introduced into such slot, which results in the above-mentioned disadvantages. Thus, although it is possible to color separate strands of hair with the slot which is provided at the handle end, the coloring is very time consuming, since only one strand is colored at a time. Furthermore, there exists the danger that, when applying the color medium onto a strand, the color medium is smeared onto previously treated strands.

A basic purpose of the invention is therefore to provide a color-applying apparatus of the above-mentioned type which permits a quick and precise coloring of separate, precisely defined strands of hair.

SUMMARY OF THE INVENTION

This is attained according to the invention by providing a comb having teeth which are substantially triangularly shaped in a top view, are arranged a relatively large distance from one another and are tapered toward their tips, and having gaps between the teeth which are substantially triangularly shaped in a top view and taper toward the comb back. Each tooth, in its enlarged part near the comb back, has a color chamber which opens toward one side surface of the comb and has a narrow slot which extends from the tooth tip into the color chamber perpendicular to the comb back.

In the inventive color-applying comb, the teeth expand triangularly toward the comb back, so that they can have near the comb back relatively large color chambers. It is then also possible to fill these color chambers with a relatively large quantity of a color medium, so that they can be refilled less often. In particular, it is always assured that the color medium whic is contained in the filled color chambers is sufficient for the complete coloring of an entire strand of hair. Furthermore, it is achieved through the triangularly shaped teeth which are arranged a relatively large distance from one another that, between the teeth, triangularly shaped gaps are formed which are relatively wide in the region of the tooth tips. A relatively large amount of hair is received by these gaps, and is thus not colored. Only separate, spaced strands of hair are received in the slots provided in each tooth and, during further movement of the comb, receive from the color chambers the color medium. Thus, the color medium is always applied only to separate strands which are distinct from the remaining hair, while the larger portion of the hair which is combed by the comb does not receive any application of the color medium. Furthermore, since the comb has several teeth with color chambers and slots, when pulling the comb through the hair, several strands are simultaneously exposed to the color medium. By means of the inventive color-applying comb, a quick coloring of thin and clearly defined strands of hair is possible.

BRIEF DESCRIPTION OF THE DRAWINGS

The invention will be discussed in greater detail hereinafter in connection with the exemplary embodiment which is illustrated in the drawings, in which.

DETAILED DESCRIPTION

Figure 1:
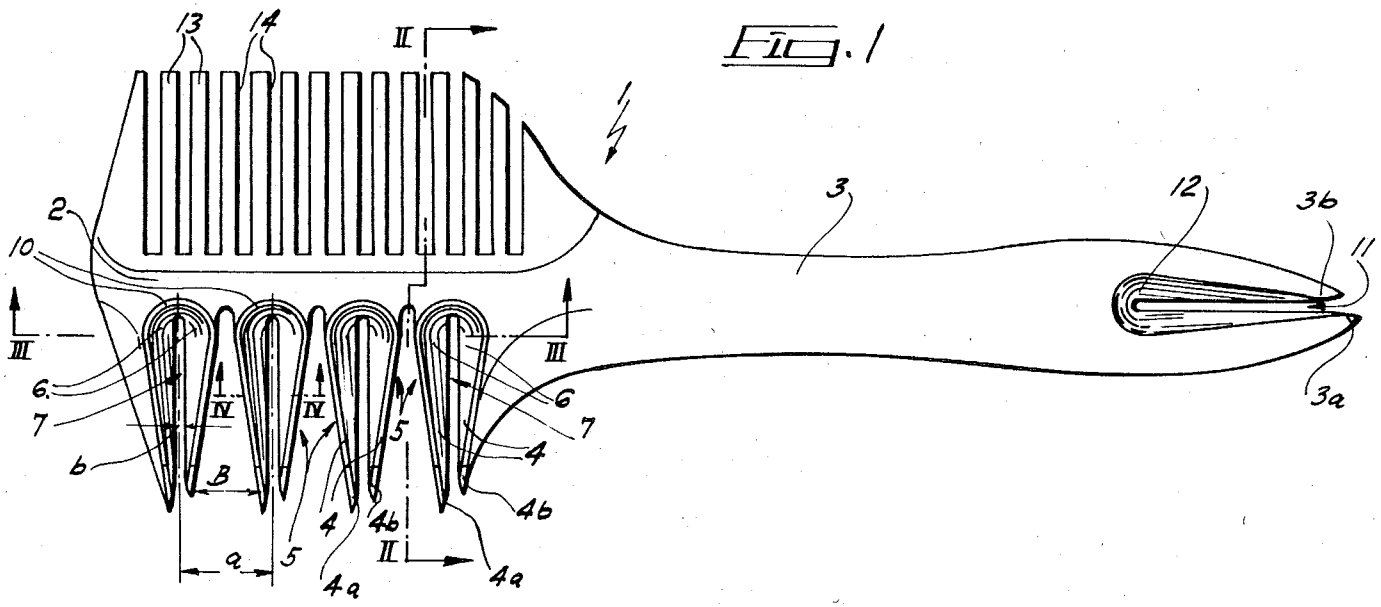
FIG. 1 is a top view of a comb embodying the invention.

The color-applying comb 1 has an elongate comb back 2 and a comb handle 3 which is connected thereto. Four teeth 4 which are substantially triangularly shaped in the top view of FIG. 1 are provided on one side of the comb back 2 and are spaced from one another by relatively large distances a. Each of these four teeth 4 is generally arrow-shaped and tapers toward its tip, or in other words enlarges toward the tooth back 2. Between the teeth 4 are gaps 5 which are triangularly shaped in the top view of FIG. 1 and taper toward the comb back 2. The distance a from tooth center to tooth center is preferably in the range of approximately 14–16 mm, and preferably 15 mm.

Each tooth 4 has in its enlarged part near the comb back 2 a color chamber 6. Furthermore, a slot 7 is provided in each tooth 4 and extends from the tooth tip into the color chamber 6 perpendicular to the comb back 2, thereby defining two tips 4*a* and 4*b* on each tooth 4.

Each slot 7 advantageously has a width b which is constant along the length of the slot in the top view, and is preferably approximately 2 mm. The width B of the gaps 5 in the region of the tooth tips 4*a* and 4*b* is preferably about 6 times as large as the width b of the slots 7.

Figure 2:
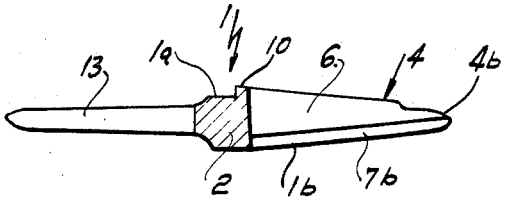
FIG. 2 is a sectional view taken along the line II—II of FIG. 1.

In order to make the capacity of the color chambers 6 as large as possible, they each extend, as is illustrated in FIG. 2, from location near the comb back 2 to a location near the tooth tips 4*a* and 4*b*.

Figure 3:
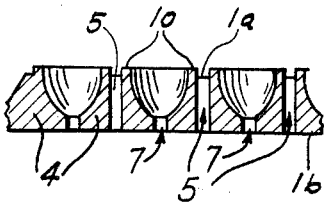
FIG. 3 is a fragmentary sectional view taken along the line III—III of FIG. 1.
Figure 4:
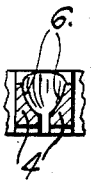
FIG. 4 is a fragmentary sectional view of a single tooth taken along the line IV—IV of FIG. 1.
Figure 6:
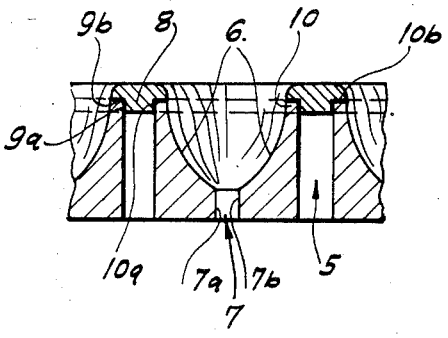
FIG. 6 is a fragmentary sectional view of the template taken along the line VI—VI of FIG. 5 and shows the comb of FIG. 1 in association therewith.
Figure 7:
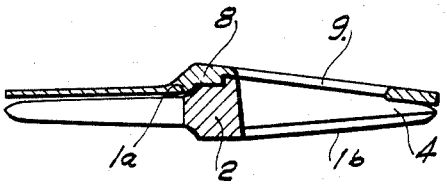
FIG. 7 is a sectional view of the template along the line VII—VII of FIG. 5 and shows the comb of FIG. 1 in association therewith.
Figure 8:
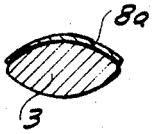
FIG. 8 is a sectional view of the template taken along the line VIII—VIII of FIG. 5 and shows the comb of FIG. 1 in association therewith.
Figure 5:
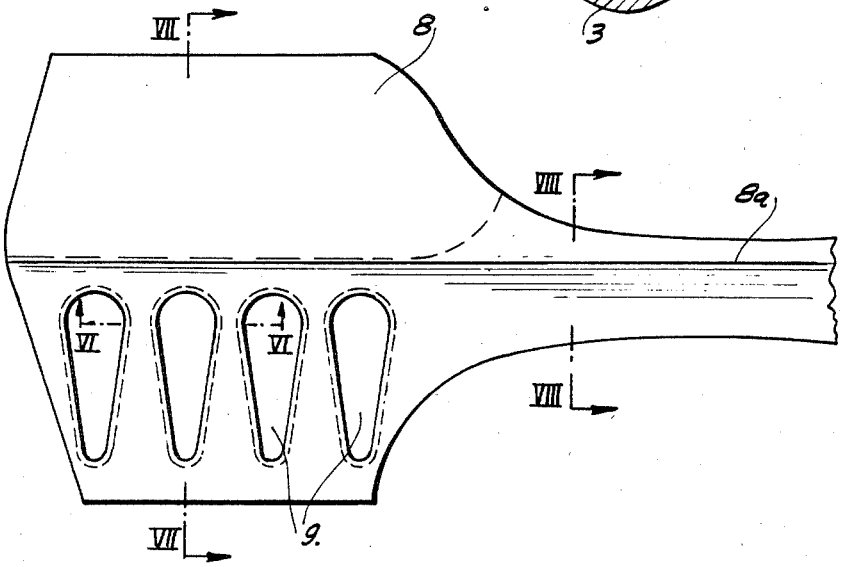
FIG. 5 is a top view of a template for introducing a color medium into color chambers of the comb of FIG. 1.

Furthermore, it is advantageous if the color chambers 6, as shown in FIGS. 3 and 4, taper in cross section from the upper side surface 1*a* of the comb 1 toward the lower side surface 1*b* of the same. The color chambers 6 open through the upper surface 1*a*, extend to a location spaced slightly above the lower side surface 1*b*, and terminates there in the slots 7. The slots 7 each have parallel side surfaces 7*a* and 7*b* (FIG. 6).

Furthermore, it is advantageous if the slots 7 and the gaps 5 extend approximately equal distances toward the comb back 2. In other words, the inner ends of the slots 7 and the gaps 5 are preferably aligned.

It can be seen from FIG. 2 that the height of each tooth 4 increases toward the tooth back 2.

The slots 7 in the teeth 4 serve to guide the hair strands which are to be colored. In order for these to be better guided into the slots 7, it is advantageous if each tooth 4 is slightly longer on one side of the slot 7 than on the other side, so that the tooth tip 4*a* projects outwardly slightly beyond the tooth tip 4*b*, as shown in FIG. 1.

Prior to the use of the color-applying comb 1 for coloring of hair strands, the color chambers 6 must be filled with a color medium, for example a bleaching medium. It is hereby important that the color medium is supplied only to the color chambers 6 and not to the upper side surface 1*a* of the comb or into the gaps 5. Otherwise, portions of hair which are not intended to be colored could come into contact with the color medium and be colored. To fill the color chambers 6 with the color medium, it is therefore advantageous to provide a template 8 which can be placed onto the upper side surface 1*a* of the comb 1 and has recesses 9 which each have a contour substantially corresponding to the contour of a respective one of the color chambers 6.

In order to achieve a good sealing between the template and the upper side surface 1*a* of the comb, each color chamber is advantageously surrounded by an edge 10 which projects upwardly above the upper side surface 1*a* of the comb, and the recesses 9 of the template 8 conform to the contour of the edges 10.

In order to also prevent the color medium from penetrating between the template 8 and the upper and outer side surfaces 10*a* and 10*b* of the edges 10 at the edges of the recesses 9, it is advantageous if the boundary surfaces of the recesses 9, as illustrated in FIG. 6, are constructed in teps and include perpendicular surface portions 9*a* and 9*b*, so that the template 8 with one portion 9*a* of the step-shaped boundary surface covers the outer side surface 10*a* of the projecting edge 10 and with the other portion 9*b* of its boundary surface covers the upper side surface 10*b* of the projecting edge 10.

In order for the template 8 to rest as well as possible on the upper side surface 1*a* of the comb 1, it is advantageous if the template 8 conforms in shape to the upper side surface 1*a* of the comb 1. Furthermore, the template 8 has a handle portion 8*a* which rests on and conforms in shape to the comb handle 3. If one places the template 8 onto the upper side surface 1*a* of the comb handle 3, then it stays there by itself, due to such conformity, especially since it is centered with respect to the comb 1 ad the color chambers 6 by means of the edges 10 which engage the boundary surface portions 9*a* and 9*b* of the recesses 9. The part 8*a* of the template 8 which covers the comb handle 3 has the advantage that, by gripping the comb handle 3 with one hand, the user simultaneously holds both the comb 1 and the template 8, so that the other hand is free to apply the color medium.

Furthermore, it is advantageous to provide at the free end of the comb handle 3 a slot 11 which extends longitudinally of the handle 3 and defines two tips 3*a* and 3*b*, and a color chamber 12 which is arranged at the inner end of the slot 11. The design of the handle end, including the slot 11 and the color chamber 12, is similar to the design of the slots 7 and the color chambers 6 in the teeth 4. With respect to details, reference is therefore made to the above description.

Finally, the comb 1 has a plurality of further teeth 13 on the comb back 2 which extend in a direction opposite the teeth 4 and are constructed like the teeth of a conventional comb, namely, with relatively small gaps 14 therebetween which have parallel side surfaces.

The inventive color-applying comb 1 is used as follows. The teeth 13 can be used for organizing and combing out the hair like a normal comb. Prior to coloring individual strands of hair, the color chambers 6 must be filled with the color medium. For this, the template 8 is placed onto the upper side surface 1*a* of the comb so that the boundary surface portions 9*a* and 9*b* of the recesses 9 snugly surround the edges 10 of the color chambers 6. The handle 3 and the portion 8*a* of the template 8 can be held tightly with one hand. The other hand is used to apply the color medium onto the template 8, so that it penetrates into the color chambers 6 and partly into the slots 7. Since, however, the slots 7 are relatively narrow, they prevent the color medium from passing therethrough and exiting at the underside 1*b* of the comb. After filling the color chambers 6, the template 8 is removed and the teeth 4 of the comb 1 are pulled through the organized hair. The teeth 4 of the comb hereby part the hair into different width strands. Most of the hair is received in the form of wide strands in the gaps 5. Narrow strands of hair, however, are guided into the slots 7 by the tooth tips 4*a* and 4*b*. These narrow strands of hair pick up the color medium from the color chambers 6. Since the color chambers 6 taper toward the underside 1*b* of the teeth 4, the color medium is massaged into the narrow strands of hair and excess color medium is wiped off. The wider strands of hair which are pulled into the gaps 5 do not come into contact with the color medium and thus remain uncolored. Thus, by pulling the color-applying comb 1 through the hair, it is possible in one operation and depending on the number of teeth 4, to provide narrow and precisely limited strands of hair with a color medium.

If the user wants to color only selected strands of hair, then he or she uses the free end of the comb handle 3. The color medium is introduced into the color chamber 12 and the handle end is then pulled through the hair. Only a single narrow strand of hair is guided into the slot 11, and the color medium is applied to this strand in the above-described manner.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A hair coloring apparatus, comprising a color-applying comb having several teeth arranged on a comb back and having gaps which lie between said teeth, wherein said teeth are spaced by relatively large distances from one another, are substantially triangularly shaped in a top view, and taper toward their tips, wherein said gaps are substantially triangularly shaped in a top view and taper toward said comb back, wherein each said tooth has in an enlarged part thereof near said comb back a color chamber which is a recess provided in an upper side surface of said comb, and wherein each said tooth has a narrow slot therein which extends substantially perpendicular to said comb back from the tooth tip into the color chamber, said slot opening through a lower side surface on the opposite side of said comb from said upper side surface.

2. The apparatus according to claim 1, wherein each said slot has a width which is substantially constant along the length thereof.

3. The apparatus according to claim 1, wherein said color chambers each extend from the region of said comb back to the region of the tip of a respective said tooth.

4. The apparatus acording to claim 1, wherein said color chamber each taper in cross section from said upper side surface of said comb toward said lower side surface of said comb.

5. The apparatus according to claim 4, wherein each said slot has substantially parallel sidewalls and thus a substantially constant width, and wherein each said color chamber tapers to a location near said lower side surface of said comb and terminates there in the associated slot.

6. The apparatus according to claim 1, wherein said slots and said gaps between said teeth extend approximately equal distances from the tips of said teeth toward said comb back.

7. The apparatus according to claim 1, wherein said gaps between said teeth, in the region of the tooth tips, each have a width which is approximately six times as large as the width of one of said slots.

8. The apparatus according to claim 1, wheein the distance between the centers of each adjacent pair of said teeth is in the range of 14 to 16 mm.

9. The apparatus according to claim 1, wherein the cross section of each said tooth increases in size toward said comb back.

10. The apparatus according to claim 1, wherein each said tooth is slightly longer on one side of said slot therein than on the other side.

11. The apparatus according to claim 1, including a template for facilitating filling of said color chambers with a color medium, wherein said template can be placed onto said upper side surface of said comb and has recesses which each substantially correspond in shape with the contour of a respective one of said color chambers.

12. The apparatus according to claim 11, wherein each said color chamber is surrounded by an edge which projects upwardly beyond said upper side surface of said comb, and wherein each said recess in said template has a boundary surface which corresponds in shape with the contours of said edge of the corresponding color chamber.

13. The apparatus according to claim 12, wherein said boundary surfaces of said recesses in said template are stepped, so that each said boundary surface of said template has a first surface portion which engages a side surface of the associated edge and a second surface portion which covers the upper side of the associated edge.

14. The apparatus according to claim 11, wherein said template has a lower surface which conforms in shape to said upper side surface of said comb and has a handle portion which extends into the region of a handle of said comb.

15. The apparatus according to claim 1, including at the free end of said comb a handle, a handle slot which extends longitudinally of said handle and a color chamber which is arranged at an inner end of said handle slot and is a recess provided in said upper side surface of said comb, said handle slot opening through said lower side surface of said comb.

16. The apparatus according to claim 1, including a plurality of further teeth which are provided on said comb back and project outwardly therefrom in a direction substantially opposite said first-mentioned teeth.

17. The apparatus according to claim 1, wherein each said color chamber is an upwardly facing concave recess provided in said upper side surface of said comb and is approximately teardrop shaped in a top view.

* * * * *